US010384365B2

(12) United States Patent
Gass et al.

(10) Patent No.: US 10,384,365 B2
(45) Date of Patent: Aug. 20, 2019

(54) BLADE TILT MECHANISMS FOR TABLE SAWS

(71) Applicant: SawStop Holding LLC, Tualatin, OR (US)

(72) Inventors: Stephen F. Gass, West Linn, OR (US); J. David Fulmer, West Linn, OR (US); James F. W. Wright, Sherwood, OR (US)

(73) Assignee: SawStop Holding LLC, Tualatin, OR (US)

( * ) Notice: Subject to any disclaimer, the term of this patent is extended or adjusted under 35 U.S.C. 154(b) by 0 days.

(21) Appl. No.: 15/845,639

(22) Filed: Dec. 18, 2017

(65) Prior Publication Data

US 2018/0104844 A1 Apr. 19, 2018

Related U.S. Application Data

(63) Continuation of application No. 13/946,101, filed on Jul. 19, 2013, now Pat. No. 9,844,891.

(60) Provisional application No. 61/741,493, filed on Jul. 20, 2012.

(51) Int. Cl.
*B27B 5/24* (2006.01)
*B27B 5/18* (2006.01)

(52) U.S. Cl.
CPC ..... *B27B 5/243* (2013.01); *B27B 5/181* (2013.01); *B27B 5/187* (2013.01); *Y10T 83/7697* (2015.04)

(58) Field of Classification Search
CPC ..... Y10T 83/7697; Y10T 83/7701; Y10T 83/7705; Y10T 83/7722; Y10T 83/773; Y10T 83/8773; Y10T 83/853; Y10T 83/855; Y10T 83/86; B27B 5/24; B27B 5/243; B27B 5/36; B27B 5/181; B27B 5/182; B27B 5/187; B23D 45/021; B23D 45/024; B23D 45/06; B23D 45/061; B23D 45/062; B23D 45/068; B23D 45/02
See application file for complete search history.

(56) References Cited

U.S. PATENT DOCUMENTS

| | | | | |
|---|---|---|---|---|
| 2,265,407 A | | 12/1941 | Tautz | |
| 2,974,693 A | | 3/1961 | Goldschmidt et al. | |
| 3,572,174 A | * | 3/1971 | Lynn | B23Q 1/522 74/411.5 |
| 4,249,442 A | | 2/1981 | Fittery | |

(Continued)

FOREIGN PATENT DOCUMENTS

| | | |
|---|---|---|
| CA | 2330872 A1 | 8/2001 |
| EP | 1110650 A1 | 6/2001 |

(Continued)

OTHER PUBLICATIONS

SI16WA-WF Circular Saw with Tilting Blade Spare Parts Catalogue, SCMI Corporation, Norcross, GA, Nov. 1986 and 1991.

(Continued)

*Primary Examiner* — Phong H Nguyen

(57) ABSTRACT

Blade tilt mechanisms for table saws are disclosed. The disclosed tilt mechanisms provide easy and intuitive operation. They also provide auto-locking so that a user simply releases a component to lock the blade at a specific angle. The tilt mechanisms also provide defined incremental steps for the tilt of the blade and the steps are typically spaced at 1-degree intervals.

5 Claims, 20 Drawing Sheets

(56) References Cited

U.S. PATENT DOCUMENTS

| | | | | |
|---|---|---|---|---|
| 4,503,739 | A | 3/1985 | Konieczka | |
| 4,516,612 | A | 5/1985 | Wiley | |
| 5,230,269 | A | 7/1993 | Shiotani et al. | |
| 5,575,191 | A * | 11/1996 | Wang | B27G 5/02 83/699.51 |
| 5,713,258 | A * | 2/1998 | Keddie | B23D 51/02 83/581 |
| 6,530,303 | B1 | 3/2003 | Parks et al. | |
| 6,722,242 | B2 | 4/2004 | Chuang | |
| 6,986,370 | B1 | 1/2006 | Schoene et al. | |
| 6,994,004 | B2 | 2/2006 | Gass et al. | |
| 7,350,444 | B2 | 4/2008 | Gass et al. | |
| 7,707,920 | B2 | 5/2010 | Gass et al. | |
| 7,827,893 | B2 | 11/2010 | Gass et al. | |
| 2001/0032534 | A1 | 10/2001 | Ceroll et al. | |
| 2002/0178889 | A1 | 12/2002 | Huang | |
| 2004/0226800 | A1 | 11/2004 | Pierga et al. | |
| 2006/0201296 | A1 | 9/2006 | Kuo | |
| 2007/0186742 | A1 * | 8/2007 | Liu | B23D 45/068 83/477.2 |
| 2008/0083313 | A1 | 4/2008 | Chuang | |
| 2008/0092709 | A1 | 4/2008 | Gaw | |
| 2008/0289469 | A1 | 11/2008 | Chuang | |
| 2009/0224114 | A1 * | 9/2009 | Chuang | B23D 45/024 248/188.4 |
| 2010/0005939 | A1 | 1/2010 | Burke et al. | |
| 2010/0050843 | A1 | 3/2010 | Gass et al. | |
| 2010/0051138 | A1 * | 3/2010 | Yu | B23D 59/002 144/420 |
| 2010/0132527 | A1 * | 6/2010 | Liu | B23D 45/068 83/477.1 |
| 2011/0041667 | A1 | 2/2011 | Chiang | |
| 2011/0146470 | A1 | 6/2011 | Lin | |
| 2011/0314986 | A1 | 12/2011 | Doumani et al. | |
| 2012/0006171 | A1 | 1/2012 | Liu | |
| 2012/0204688 | A1 | 8/2012 | Rowe | |
| 2014/0260869 | A1 | 9/2014 | Frolov | |

FOREIGN PATENT DOCUMENTS

| | | | |
|---|---|---|---|
| WO | WO 01/26064 | A2 | 4/2001 |
| WO | WO 10/059786 | A1 | 5/2010 |

OTHER PUBLICATIONS

Whirlwind Model 212 Cut-Off Saw Owner's Manual, Whirlwind, Inc., Apr. 1991.
Inca 2100SE Professional Tablesaw Owners Manual, Injecta Machinery, 1992.
Inca 2200 Table Saw Photo of Internal Mechanisms, around 1992.
Whirlwind Model 212 Semi-Automatic Cut-Off Saw Brochure, Whirlwind, Inc., Jan. 1993.
Skil Model 3400-Type 1 10" Table Saw Parts List and Technical Bulletin, S-B Power Tool Company, Jun. 1993.
SI320 Circular with Tilting Blade Spare Parts Catalogue, SCM, Dec. 23, 1998.
SI3200/3800 Circular with Tilting Blade Spare Parts Catalogue, SCM, Dec. 23, 1998.
Altendorf publication, Wilhelm Altendorf GmbH & Co. KG, Minden, Germany, 1999.
Grizzly Industrial, Inc. Heavy-Duty 12" Table Saw Model G5959 and G9957 Parts List, 1998 and Oct. 2001.
SI300N Circular with Tilting Blade Spare Parts Catalogue, SCM, Jun. 12, 2000.
Bosch Model 4000 Worksite Table Saw Operating/Safety Instructions, S-B Power Tool Company, Jul. 2000.
SI400N Circular with Tilting Blade Spare Parts Catalogue, SCM, Sep. 19, 2000.
DeWalt Woodworker's Table Saw DW746 Instruction Manual, DeWalt Industrial Tool Co., 2000.
Ryobi 10" Table Saw BT3000 Operator's Manual, Ryobi Technologies, Inc., Mar. 2001.
SC 3W Circular Saw Manual, SCM Group S.p.A Divisione Minimax—Samco, Feb. 2001.
Bosch 10" Table Saw Model 0601476139 Parts List and Technical Bulletin, S-B Power Tool Company, Apr. 2001.
SI450E Circular with Tilting Blade Spare Parts Catalogue, SCM, Apr. 26, 2001.
Powermatic 10" Tilting Arbor Saw Model 66 Instruction Manual & Parts List, JET Equipment & Tools, Jun. 2001.
Skil Model 3400 Table Saw Operating/Safety Instructions, S-B Power Tool Co., Sep. 2001.
Ryobi 10" Table Saw BT3100 Operator's Manual, Ryobi Technologies, Inc., Aug. 2002.
Rojek KPF 300A-xxxx-RN-1P3 Table Saw/Shaper Combination Machine specification sheet, Sep. 30, 2002.
Laguna Tools Signature Series by Knapp, Oct. 21, 2002.
Rojek Circular Saw PK 300 Spare part catalogue, Apr. 14, 2003.
Ridgid TS3650 Operators Manual 10" Cast Iron Table Saw, May 2003, Jun. 2003 and Jul. 15, 2003.
Porter-Cable Double Insulated 10" Bench Top Table Saw Instruction Manual, Porter-Cable Corporation, Sep. 15, 2003.
SI300S-SI300S4 Circular with Tilting Blade Spare Parts Catalogue, SCM, Oct. 30, 2003.
Craftsman® Power and Hand Tools, pp. 142-143, 2003.
The Legendary Shopsmith Mark V ad, Shopsmith, Inc., at least as early as Jan. 14, 2004.
Powermatic WMH Tool Group Operating Instructions and Parts Manual 10-inch Cabinet Saw Model 2000, Nov. 2005.
Makita Model 2704 Exploded Drawings and Parts List, Nov. 2005.
Porter-Cable 10" Portable Table Saw 3812, Porter-Cable Corporation, 2005.
Porter Cable 10" Portable Table Saw Model 3812 Parts List with Guard Exploded View, 2005.
DW745 Type 1 Table Saw Parts List, DeWalt Industrial Tool Co., 2005.
Grizzly Industrial, Inc. Model G0605X/G0606X Extreme Series 12" Table Saw Owner's Manual, Grizzly Industrial, Inc., Oct. 2006.
DW745 Heavy-Duty 10" Job Site Table Saw Manual, DeWalt Industrial Tool Co., 2006.
C10RB Jobsite Table Saw Manual, Hitachi Koki USA Ltd., 2006.
TS 250 Manual, Metabo, 2007.
TS 250 Circular Saw Parts List, Metabo, 2007.
Bosch 4100 Table Saw Parts List, Robert Bosch Tool Corporation, Feb. 14, 2008.
Grizzly Industrial, Inc. Model G0651/G0652 10" Extreme Series Table Saws Owner's Manual, Grizzly Industrial, Inc., Mar. 2008.
Bosch 4100 Table Saw Manual, Robert Bosch Tool Corporation, May 2008.
SawStop 10" Industrial Cabinet Saw Owner's Manual, SawStop, LLC, Oct. 2008.
General Model 50-300/305 MI, 50-300CE/305CE Setup and Operation Manual, General International, Jul. 2009.
JET XACTA Saw Deluxe Operating Instructions and Parts Manual, JET/Walter Meier Jet Manufacturing Inc., Dec. 2009.
Delta 10" Left Tilting Unisaw Instruction Manual, Delta Machinery, Jan. 2010.
General Model 502-70 Setup and Operation Manual, General International, Mar. 2010.
SawStop 10" Contractor Saw Owner's Manual, SawStop, LLC, May 2010.
General Model 50-200R Setup and Operation Manual, General International, Sep. 2010.
SawStop Model PCS175 10" Professional Cabinet Saw Owner's Manual, SawStop, LLC, Nov. 2012.
Dewalt Models DWE7490, DWE7491 Instruction Manual, Dewalt Industrial Tool Co., 2013.
Makita Table Saw 2704 Instruction Manual, Makita Corporation of America, date unknown.
SCM SI 450 Circular saw with tilting blade product brochure, Villa Verucchio, Italy, undated.
SCM Group publication, Rimini, Italy, undated.
Laguna Tools table saw owner's manual, date unknown.

(56) References Cited

OTHER PUBLICATIONS

Speed Reducer Self-Locking and Back-Driving, SE Encore, date unknown.
Engineering Considerations and Terminology, American Linear Manufacturers, date unknown.
Worm Gears, Martin, date unknown.

* cited by examiner

BLADE TILT MECHANISMS FOR TABLE SAWS

CROSS-REFERENCE TO RELATED APPLICATION

This application claims the benefit of and priority from U.S. patent application Ser. No. 13/946,101, filed Jul. 19, 2013, which in turn claims the benefit of and priority from U.S. Provisional Patent Application Ser. No. 61/741,493, filed Jul. 20, 2012, both of which are incorporated herein by reference.

TECHNICAL FIELD

The present disclosure relates to table saw mechanisms designed to improve convenience and performance. More specifically, this specification relates to mechanisms used to tilt the blade to make beveled or angled cuts.

BACKGROUND

A table saw is a power tool used to cut a workpiece to a desired size or shape. A table saw includes a work surface or table and a circular blade extending up through the table. A person uses a table saw by placing a piece of wood or other workpiece on the table and feeding it past the spinning blade to make a cut.

Table saws are typically constructed so that a user can adjust the angle or tilt of the blade relative to the table in order to make beveled or angled cuts. Some table saws include hand wheels that a user turns to tilt the blade. Other table saws include a clamp to hold the blade at a specific angle relative to the table. In those saws, a user changes the blade's tilt by releasing the clamp, manually tilting the blade to a desired position, and then performing some specific action to re-engage the clamp, such as tightening a knob or moving a lever.

This specification discloses tilt mechanisms that enable a user to tilt the blade easily and intuitively, that provide an auto-lock feature, and that provide defined and incremental positions for the blade.

DETAILED DESCRIPTION

Figure 1:
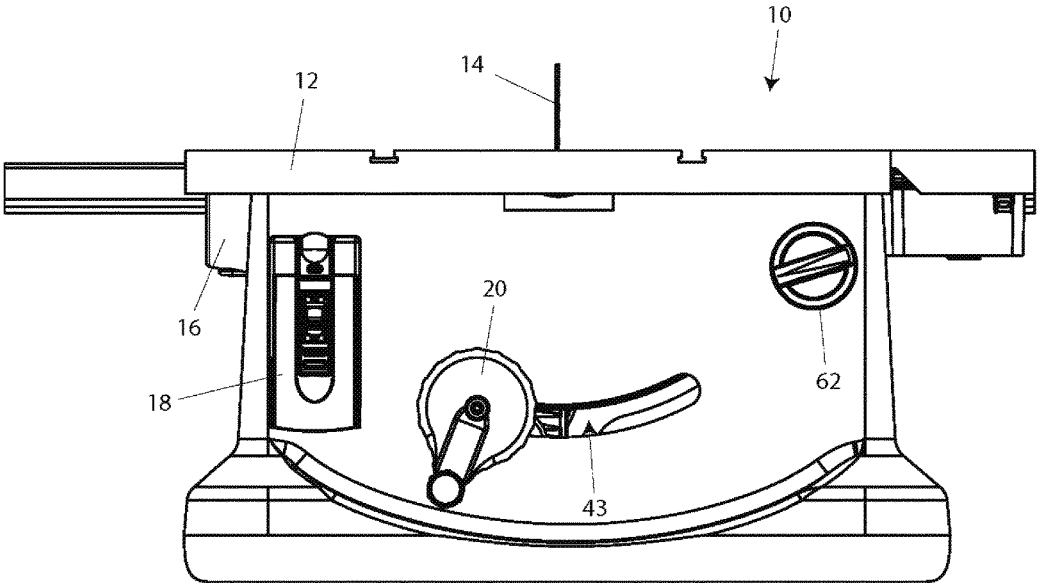
FIG. 1 shows a table saw.

FIG. 1 shows a table saw 10 including a table 12 and a circular blade 14 extending up through the table. A piece of wood, or other material to be cut, is placed on the table and pushed into contact with the spinning blade to make a cut. The saw includes a motor 16 to spin the blade, and a switch 18 to turn the motor on and off.

Table saw 10 also includes an elevation mechanism to raise or lower the blade to cut workpieces of varying thicknesses. The elevation mechanism includes a hand wheel and a user turns hand wheel 20 to raise and lower the blade.

Figure 2:
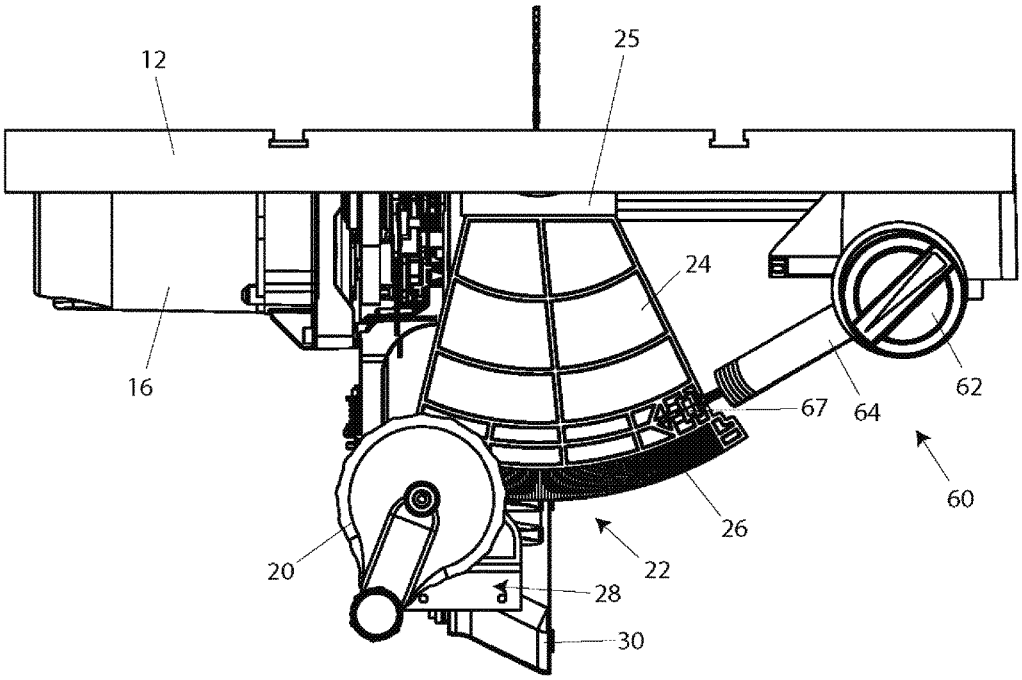
FIG. 2 shows a front view of a tilt mechanism in a table saw.
Figure 3:
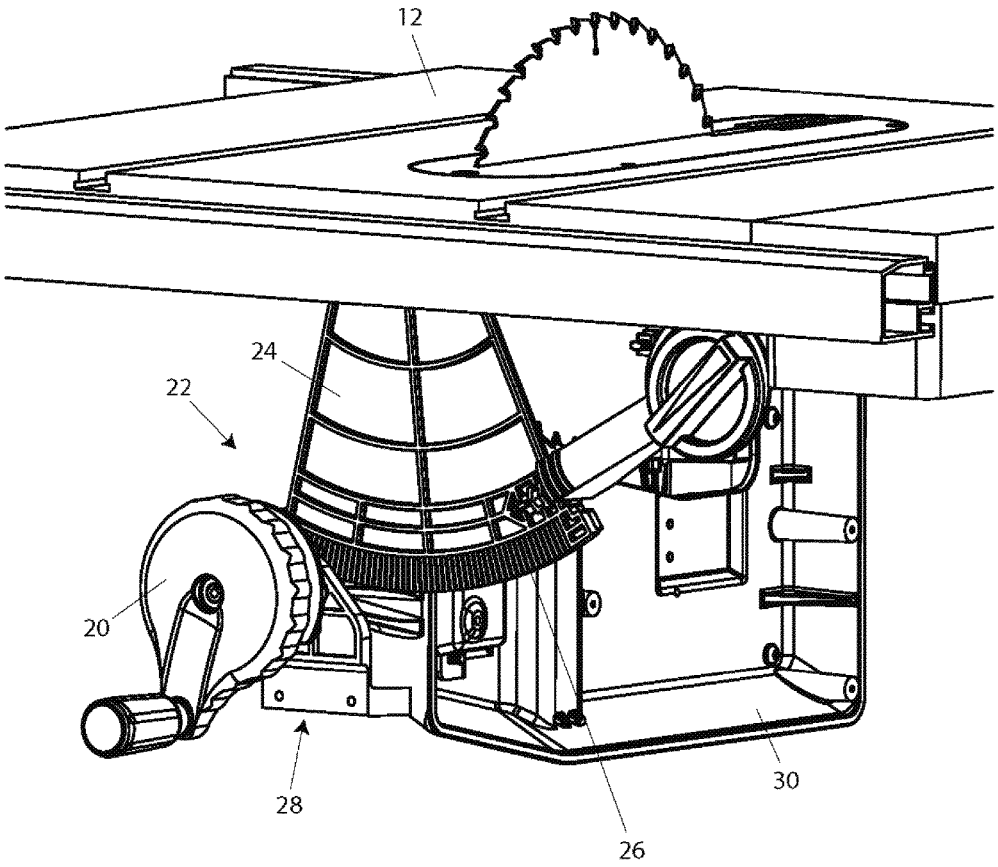
FIG. 3 shows perspective view of the tilt mechanism of FIG. 2.
Figure 4:
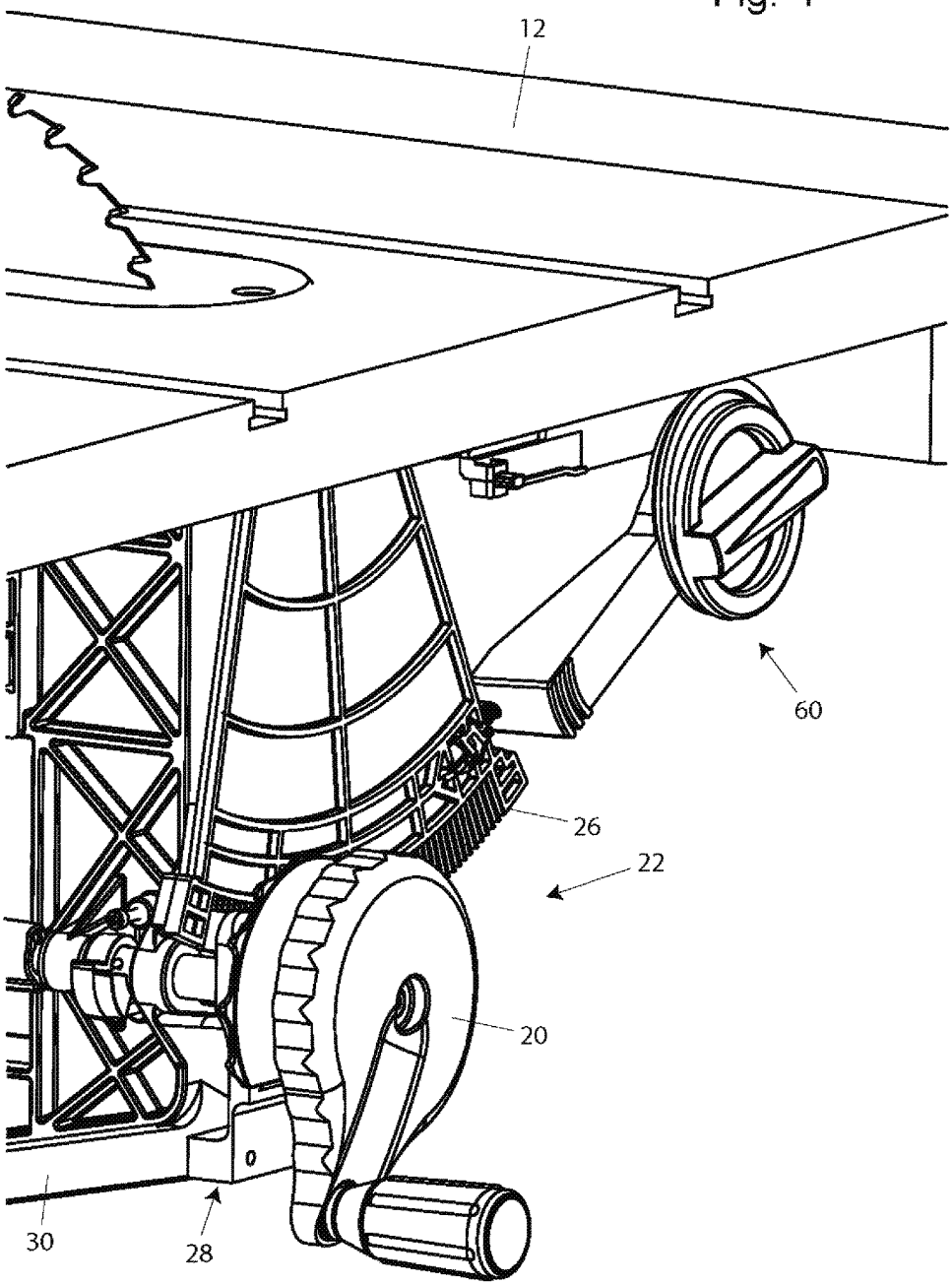
FIG. 4 shows another perspective view if the tilt mechanism of FIG. 3.

Table saw 10 further includes a tilt mechanism 22 to adjust the angle or tilt of the blade relative to the table in order to make beveled or angled cuts. FIGS. 2-4 show different views of table saw 10 with the housing removed in order to see tilt mechanism 22. Various components typically included in a table saw, such as dust shrouds, riving knife mounts, elevation mechanisms, etc., have been removed from FIGS. 2-4 to more clearly show the tilt mechanism.

Tilt mechanism 22 includes a rack 24 mounted in the saw to a front trunnion bracket 25, which in turn is mounted to the underside of table 12. The bottom of rack 24 includes an arcuate or curved section having teeth 26 with gullets between the teeth. In the embodiment shown, teeth 26 are spaced at 1-degree intervals, although they may be spaced at greater or smaller intervals. Rack 24 may be made from hard plastic or any other suitable material.

Tilt mechanism 22 also includes an engagement member 28 positioned behind hand wheel 20 and mounted to a trunnion 30. Trunnion 30 carries the blade and is supported at least in part by front trunnion bracket 25 so that the trunnion can pivot from side to side in order to tilt the blade.

Figure 5:
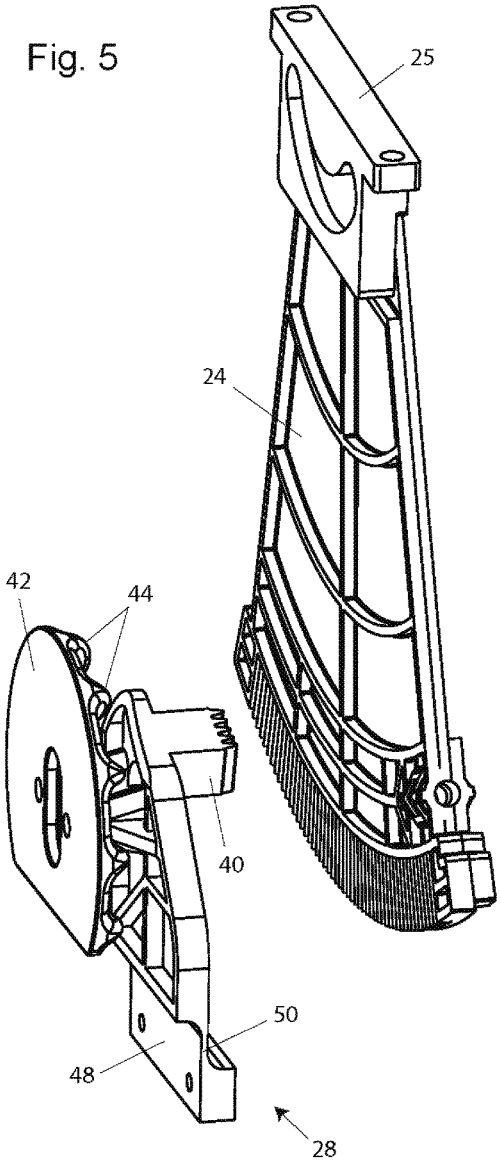
FIG. 5 shows a perspective and exploded view of a rack and an engagement member used in the tilt mechanism of FIG. 2.
Figure 6:
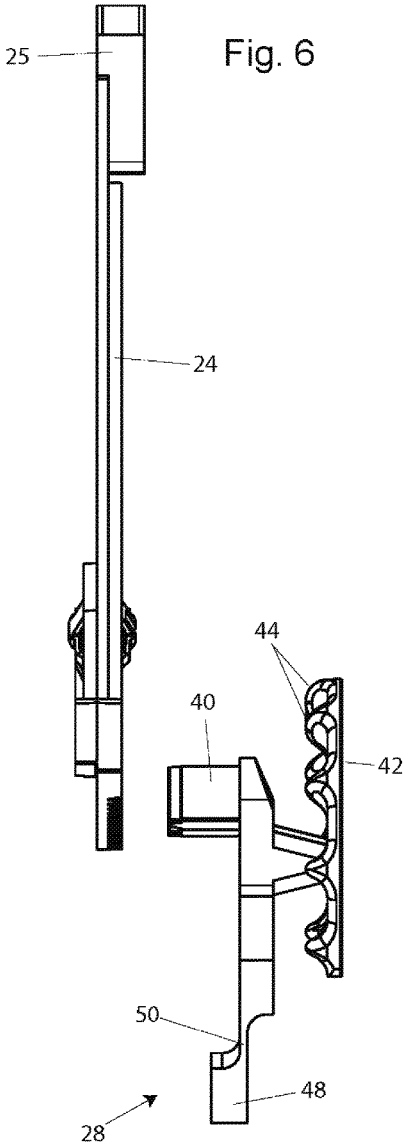
FIG. 6 shows a side view of the rack and engagement member of FIG. 5.

Engagement member 28 includes a toothed portion 40 configured to mesh with teeth 26 on rack 24, as seen in FIGS. 5 and 6. Engagement member 28 also includes a grip plate 42 configured to be engaged by a user. Grip plate 42 includes bumps 44 to increase friction with a user's hand, but may alternatively have a textured surface, a smooth surface, or some other surface.

Grip plate 42 is connected to toothed portion 40 but spaced apart so that the housing of the saw can extend between the grip plate and the toothed portion. In this configuration, grip plate 42 is outside the saw while toothed portion 40 is inside the saw. The connection between grip plate 42 and toothed portion 40 extends through an opening 43 in the housing (the opening is shown in FIG. 1). Opening 43 can be minimized by decreasing the size of the connection between grip plate 42 and toothed portion 40.

Engagement member 28 can be made from plastic, and it includes a base 48 used to mount the engagement member to trunnion 30. A thin section 50 connects base 48 to toothed portion 40 and to grip plate 42. Thin section 50 acts as a spring and allows toothed portion 40 and grip plate 42 to flex or bend relative to base 48.

Figure 7:
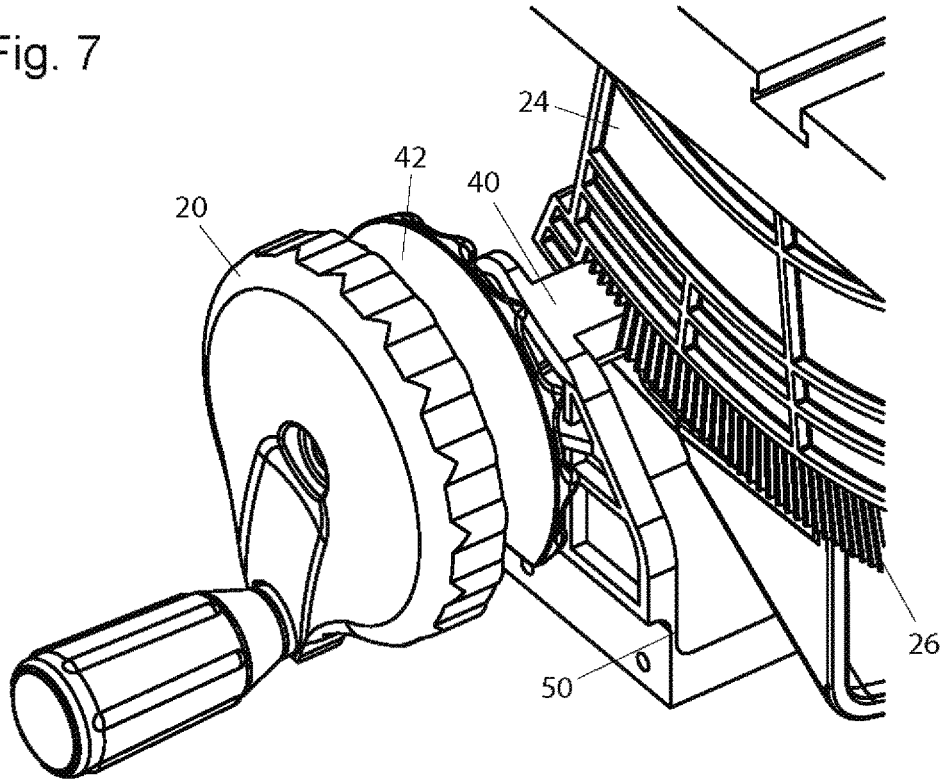
FIG. 7 shows an engagement member engaging a rack.
Figure 8:
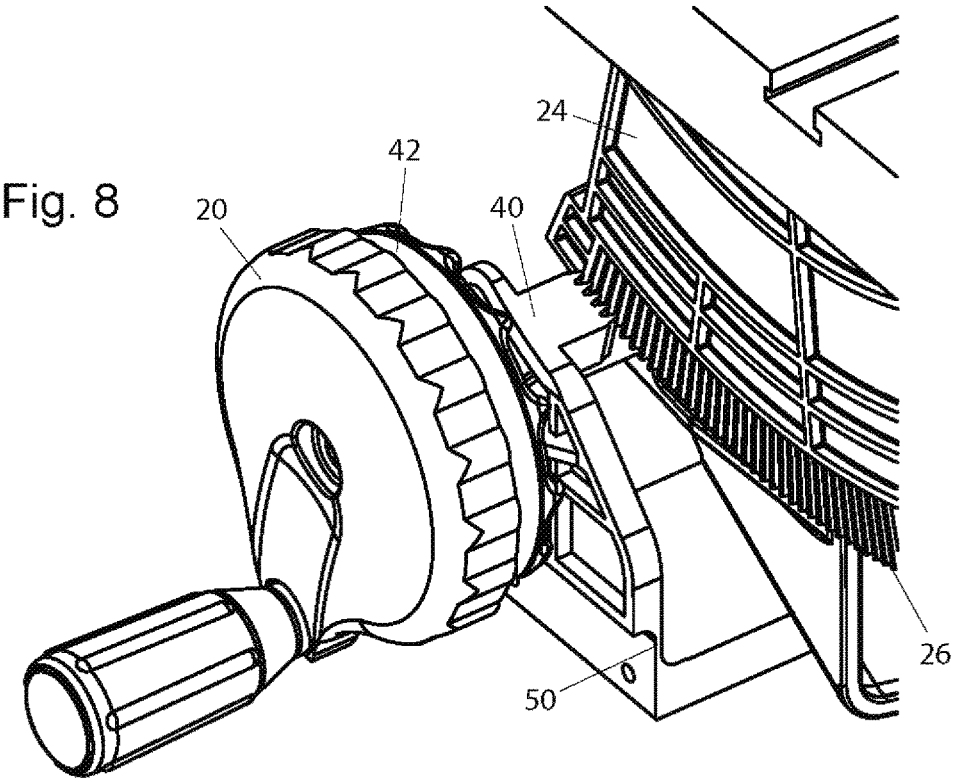
FIG. 8 shows an engagement member disengaged from a rack.
Figure 11:
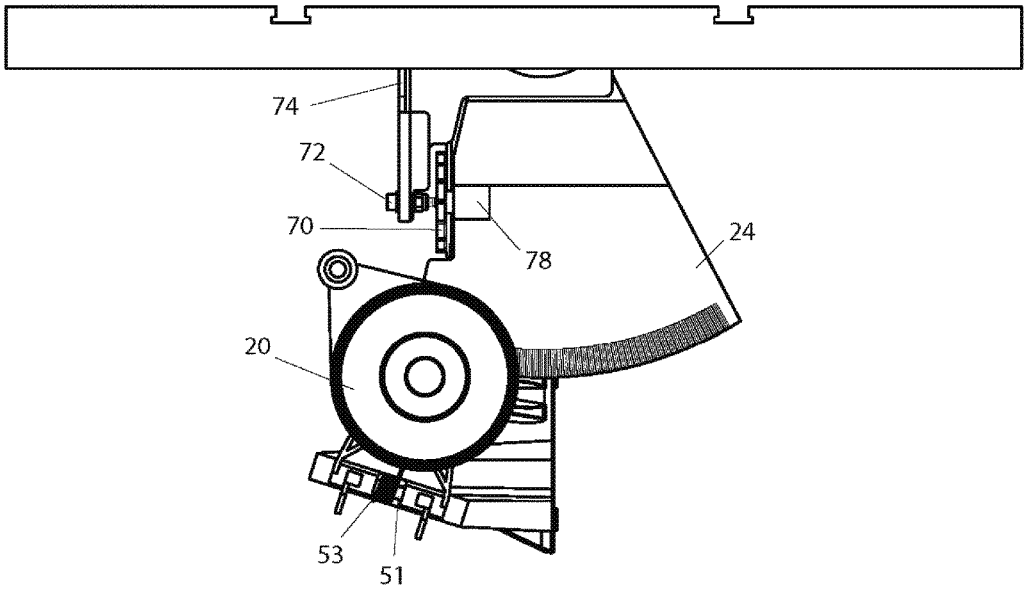
FIG. 11 shows another embodiment of an adjustment mechanism.
Figure 13:
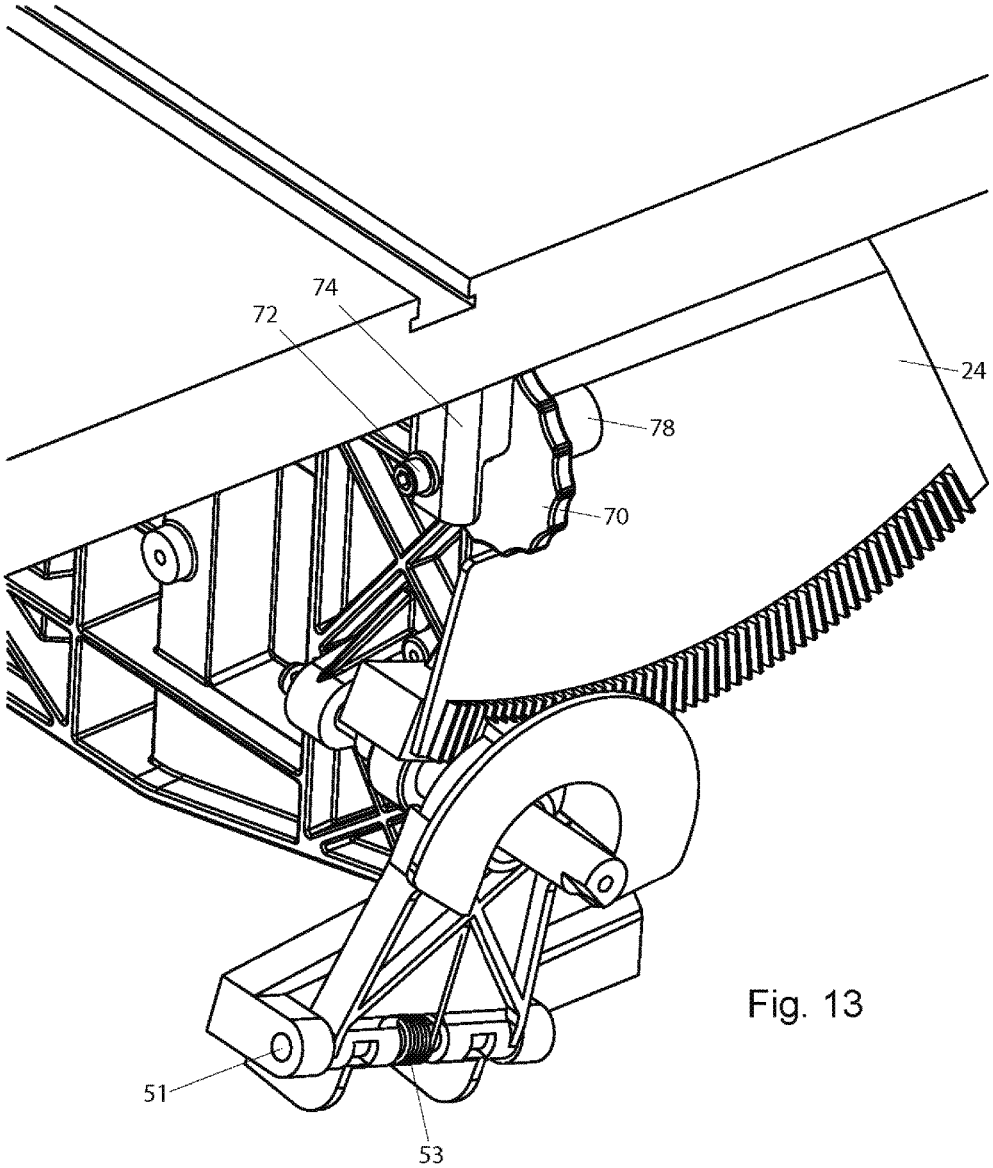
FIG. 13 shows a view of the adjustment mechanism shown in FIG. 12 with a hand wheel removed for clarity.
Figure 18:
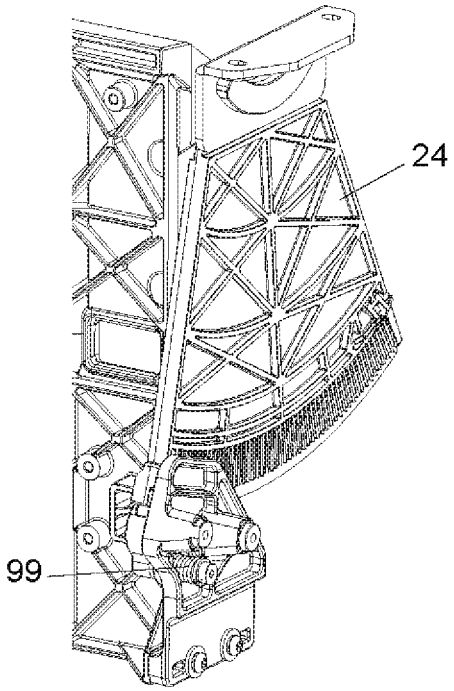
FIG. 18 shows a spring in a tilt mechanism.

FIGS. 7 and 8 illustrate how the teeth on engagement member 28 mesh with teeth 26 on rack 24. As seen in FIGS. 7 and 8, grip plate 42 is positioned behind hand wheel 20. In operation, a user would place his fingers along bumps 44 on grip plate 42 and squeeze or pull the grip plate toward hand wheel 20. As stated, thin section 50 on engagement member 28 acts as a spring and allows grip plate 42 and toothed portion 40 to flex away from rack 24 so that toothed portion 40 disengages from teeth 26 on rack 24. After squeezing or flexing the grip plate toward the hand wheel to disengage toothed portion 40 from teeth 26, the user manually tilts the blade to a desired angle or position by moving engagement member 28 to the right or left. As stated, engagement member 28 is mounted to trunnion 30 supporting the blade, and trunnion 30 is mounted in the saw to pivot to the right or left (when viewing the saw from the front), so the blade tilts as the user moves engagement member 28. When the blade is at the desired angle, the user simply releases grip plate 42. The grip plate and toothed portion automatically return back to their original position due to the spring force of thin section 50, and toothed portion 40 again engages teeth 26 on rack 24 to hold the blade at the desired angle. In this manner, the user can tilt the blade from 0 to 45 degrees. A hinged joint between the base section and the grip plate and toothed portion can replace thin section 50 in other embodiments. Such a hinged joint is shown in FIGS. 11 and 13, discussed below, and may include an axle 51 and a spring 53 to bias the grip plate and toothed portion toward rack 24. Additionally, in some embodiments a spring supported by a bolt threaded into the trunnion may be used to bias the grip plate and toothed portion toward rack 24, as shown at 99 in FIG. 18.

FIG. 7 shows toothed portion 40 engaging teeth 26 on rack 24 to hold the blade in position. FIG. 8 shows toothed portion 40 pulled away from and disengaging teeth 26 on rack 24. In the condition shown in FIG. 8, a user may tilt the blade to a desired angle by moving engagement member 28 to the right or left because toothed portion 40 does not engage teeth 26, as explained.

Toothed portion 40 of engagement member 28 meshes with teeth 26 on rack 24 to hold the blade in position. Toothed portion 40 includes a plurality of teeth in order to securely mesh with teeth 26 on rack 24 and to support the weight of the blade, trunnion and motor when the blade is tilted. Teeth 26 on rack 24 and the teeth on toothed portion 40 have the same profile and are shaped so that the teeth mesh well with little chance that vibration will cause the teeth to disengage. In the depicted embodiment the teeth have a pitch angle of 14.5-degrees to provide solid abutments to support the weight of the blade, motor, trunnion and related structure, although other pitch angles and profiles are possible.

Figure 19:
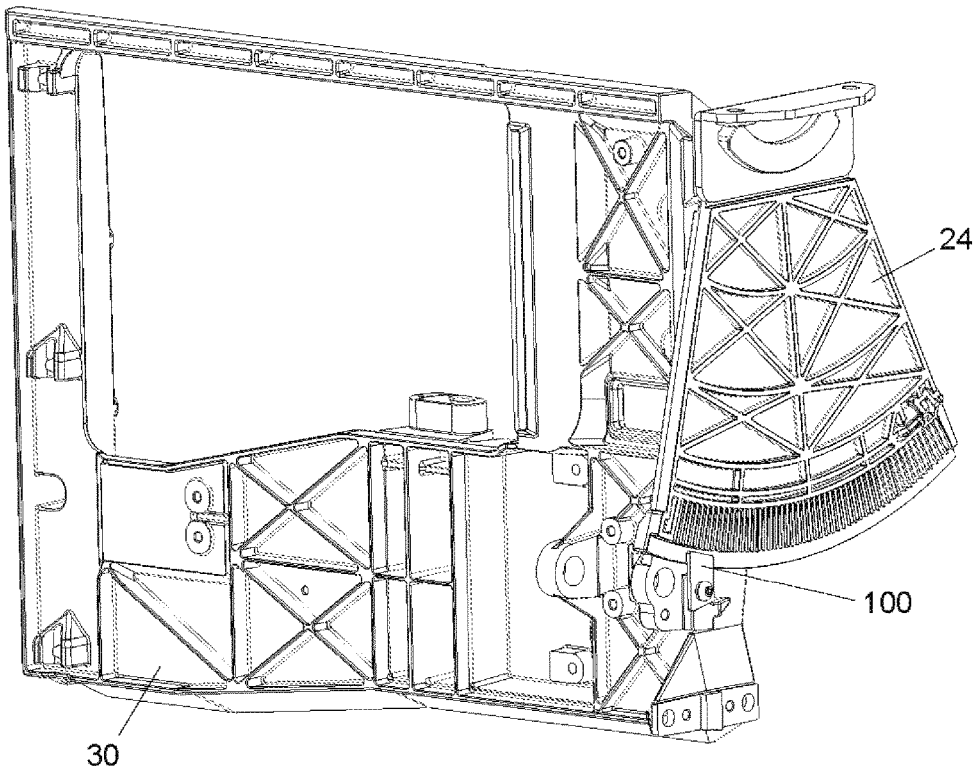
FIG. 19 shows a tab used in a tilt mechanism.

As stated, rack 24 may be made from hard plastic or any other suitable material. Rack 24 is also supported in the saw to prevent it from flexing away from engagement member 28, which might cause the teeth to disengage. In one embodiment, a tab may be added to help keep rack 24 in position so that teeth 26 on the rack and toothed portion 40 on engagement member 28 mesh reliably. FIG. 19 shows a tab 100 positioned adjacent the bottom of a rack 24 to help keep the rack in position. Tab 100 overlaps a bottom edge of the rack, and the top of the tab is cut at an angle to better match the curved bottom edge of the rack. Tab 100 may be attached to trunnion 30 in various ways, such as with a screw.

Figure 9:
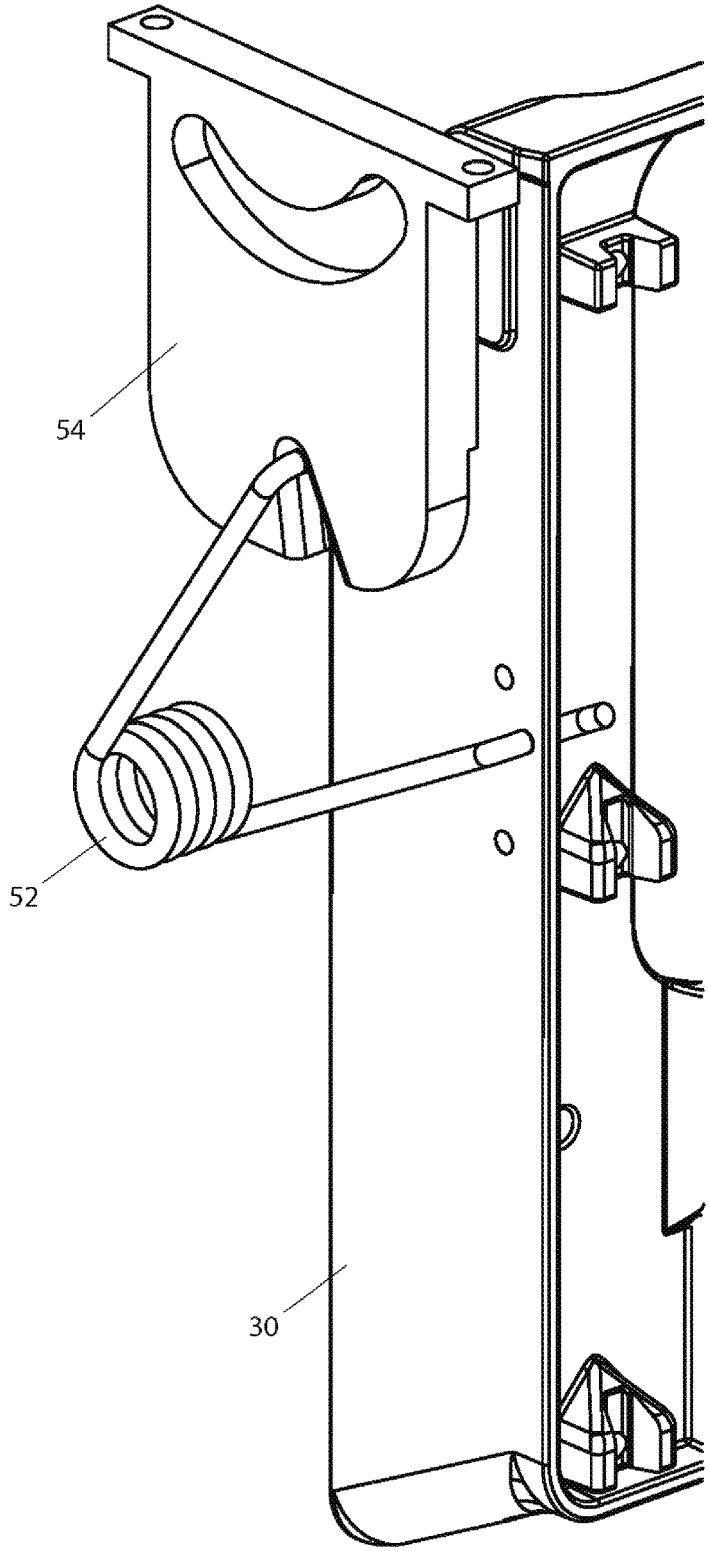
FIG. 9 shows a spring to counterbalance the weight of the blade, trunnion, motor and related structure.

FIG. 9 shows a spring 52 that can be used with the tilt mechanism to offset the weight of the blade, trunnion, motor and related structure. Spring 52 has two arms, one connected to the back side of trunnion 30 and the other connected to a rear trunnion bracket 54, as shown in FIG. 9. When the blade is perpendicular to the table top, the position and weight of the motor creates a force tending to tilt the blade, and spring 52 is positioned to offset that force, at least partially. In the embodiment depicted in FIG. 9, spring 52 is compressed so that the arms of the springs push out with a force of approximately 30 to 35 pounds when the blade is perpendicular to the table, although springs applying other forces could be used, including forces ranging from just a few pounds (e.g., 3 to 5 pounds) to 50 pounds or more. As the trunnion tilts, the spring continues to push out to balance the weight of the blade, trunnion, motor, and related structure. Tilting the trunnion toward 45-degrees compresses the spring further so that the spring applies a greater counterbalancing force.

Figure 20:
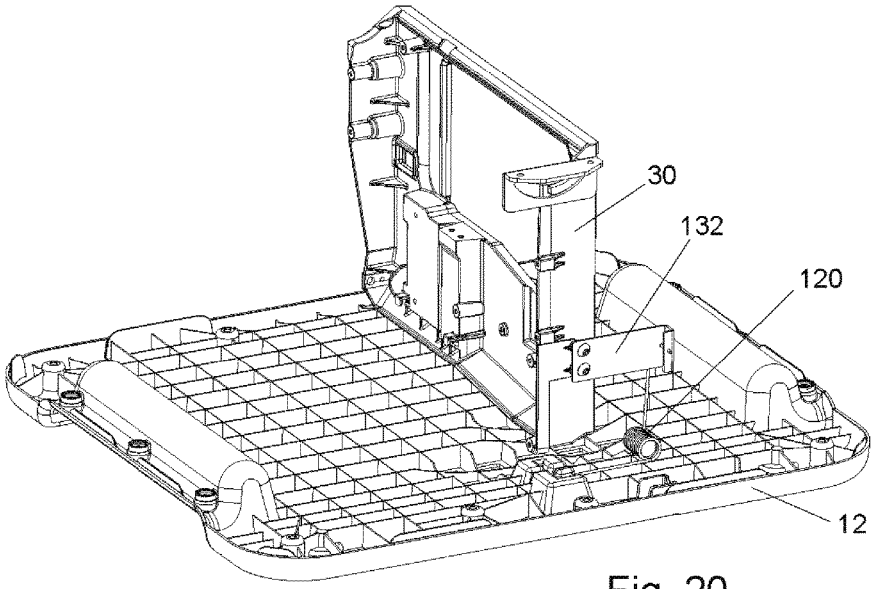
FIG. 20 shows another embodiment of spring to counterbalance the weight of the blade, trunnion, motor and related structure.
Figure 21:
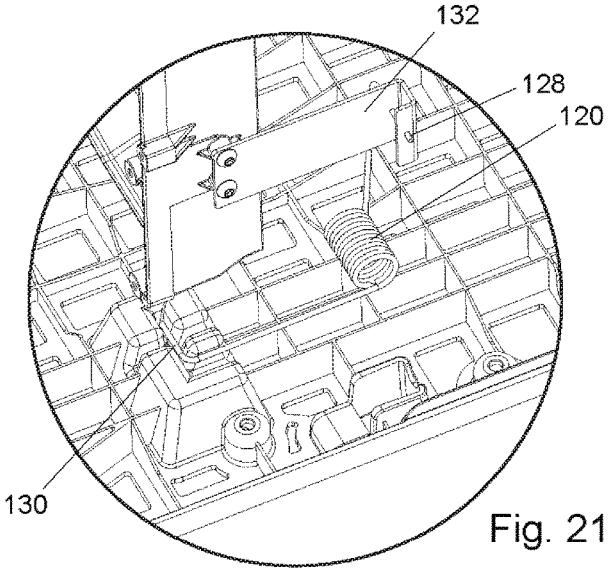
FIG. 21 shows an enlarged view of the spring of FIG. 20.
Figure 22:
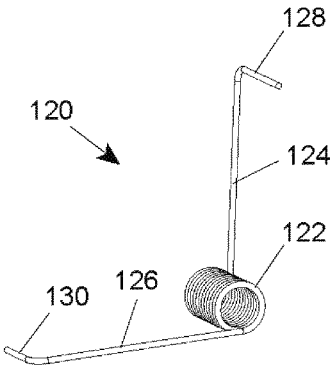
FIG. 22 shows an isolated view of the spring of FIG. 20.

FIGS. 20-22 show an alternative counterbalance spring 120. Counterbalance spring 120 includes a coil 122 with straight segments 124 and 126 at each end of the coil at a right angle to each other. The straight segments continue for a length before bending ninety degrees at ends 128 and 130 in directions parallel to the coil and back toward the coil so that the ends are pointing in opposite directions. A bracket 132 is attached to trunnion 30, and end 128 of spring 120 fits through a set of concentric holes in the bracket, as shown in FIGS. 19 and 20. (FIGS. 20 and 21 show a perspective looking at the underside of a table 12 in order to better see spring 120.) End 130 of spring 120 fits into and around a projection extending out from the bottom of table 12, as shown.

When a user tilts the blade and releases grip plate 42, toothed portion 40 will spring back toward rack 26 and the teeth will mesh. If the positions of the teeth on toothed portion 40 do not exactly align with teeth 26 on rack 24 when the user releases grip plate 42, the engagement member will shift slightly due to gravity until the teeth mesh and lock in place.

As stated, teeth 26 on rack 24 are spaced 1-degree apart, which means the blade can be tilted in 1-degree increments by moving engagement member 28. This provides the advantage of being able to tilt the blade easily to precise angles, such as 37-degrees. Accordingly, teeth 26 may be thought of as an index or indices to allow a user to tilt a blade to a defined position.

Figure 23:
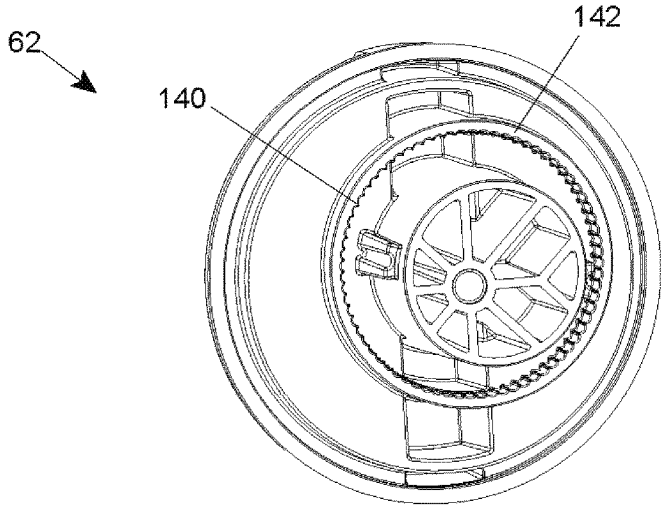
FIG. 23 shows ridges used in a tilt adjustment mechanism.
Figure 24:
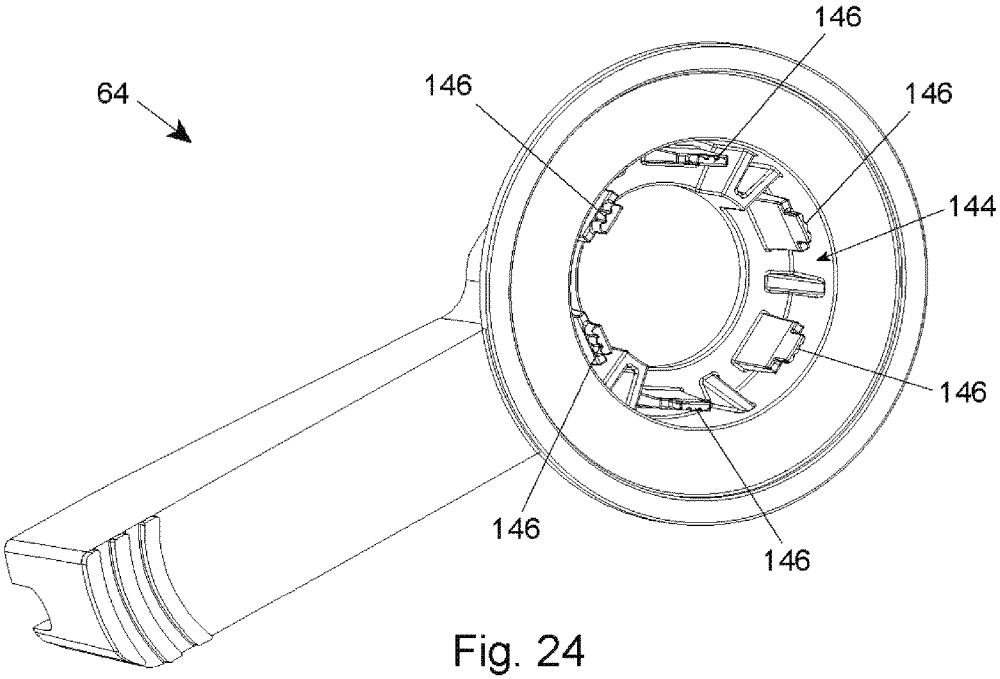
FIG. 24 shows tabs used in a tilt adjustment mechanism.

Tilt mechanism 22 includes an adjustment mechanism 60, also called a micro-adjust or micro-adjust system, to allow a user to tilt the blade to any angle between the 1-degree increments. Adjustment mechanism 60 is perhaps best shown in FIG. 2. It includes a dial 62 positioned outside the saw so that a user can engage and turn the dial. Dial 62 is eccentrically connected to an arm 64, which is inside the housing of the saw, so the dial and arm "sandwich" the housing. The other end of arm 64 attaches to rack 24. Because of the eccentric connection between dial 62 and arm 64, turning dial 62 causes arm 64 to move to the right or left. Arm 64, in turn, moves rack 24 to the right or left, and rack 24 moves engagement member 28 and blade 14 because of the engagement between toothed portion 40 and teeth 26. Dial 62 may be constructed with stops to limit the rotation of the dial and thereby limit the possible adjustment. In the depicted embodiment, dial 62 includes internal stops that limit the rotation of the dial to plus or minus 60-degrees. Additionally, the dial should be constructed so that it stays in place when turned, and the depicted embodiment includes an internal O-ring to create friction between the dial and the saw housing to hold the dial in position. Alternatively, ridges or notches between various parts of the dial may be used to hold the dial in position. For example, dial 62 may include a series of ridges 140 along an interior surface of a cylindrical shell 142 that extends out from the backside of the dial, as shown in FIG. 23. Cylindrical shell 142 fits within a corresponding cylindrical cavity 144 on arm 64. Positioned around the cylindrical cavity 144 are a number of tabs 146, as shown in FIG. 24, and each tab includes corresponding ridges or notches configured to mesh with the ridges in shell 142. Tabs 146 can flex as dial 62 is installed so that cylindrical shell 142 fits between the inner wall of cylindrical cavity 144 and the tabs. The tabs can also flex when dial 62 is rotated. Once the dial is set, the tabs spring back so that the notches in the tabs mate with the notches in the dial to help hold the dial in position. Of course other embodiments are possible.

Figure 10:
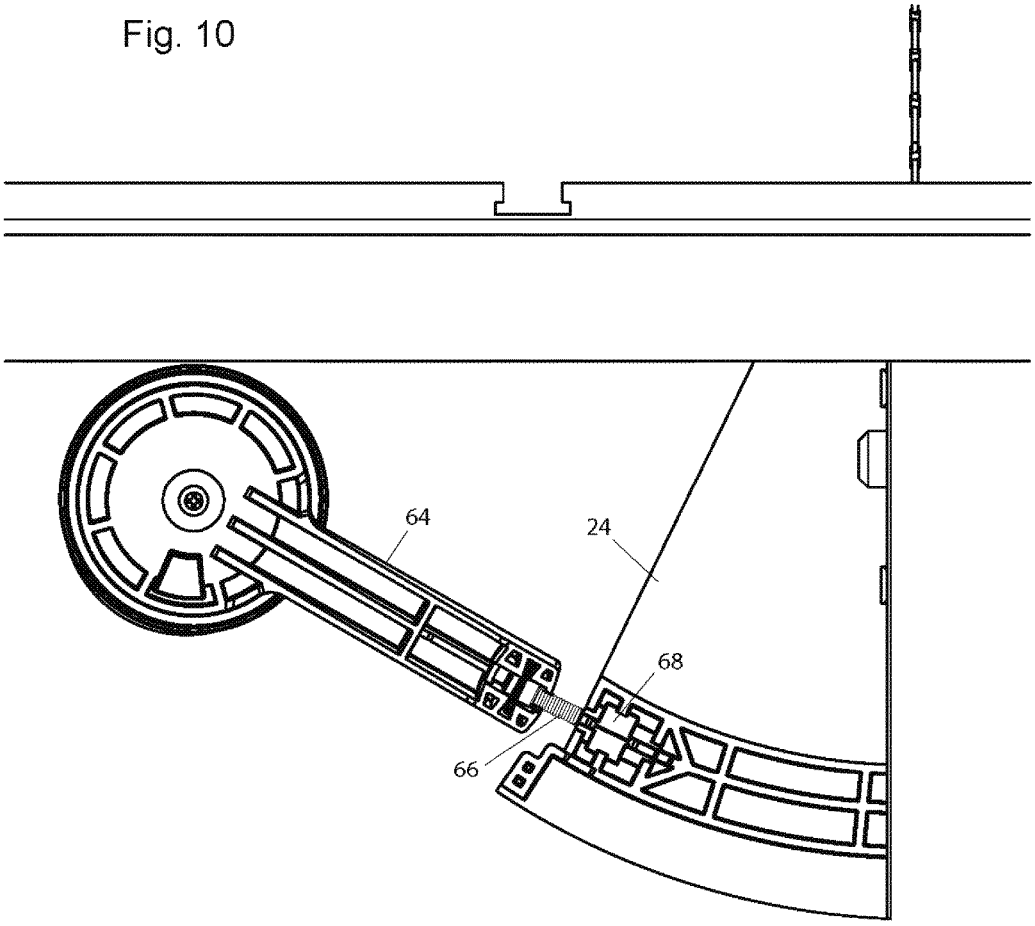
FIG. 10 shows a back view of an adjustment mechanism.

FIG. 10 shows the back side of dial 62 and arm 64 in order to show how arm 64 connects to rack 24. The head of a bolt 66 is captured in a socket in arm 64, and the threaded end of the bolt engages a nut 67 (shown in FIG. 2) captured in a socket 68 in rack 24. The bolt can be turned using a 90-degree hex wrench, and turning the bolt adjusts the spacing between rack 24 and arm 64 to properly align the blade and rack in the saw.

Figure 25:
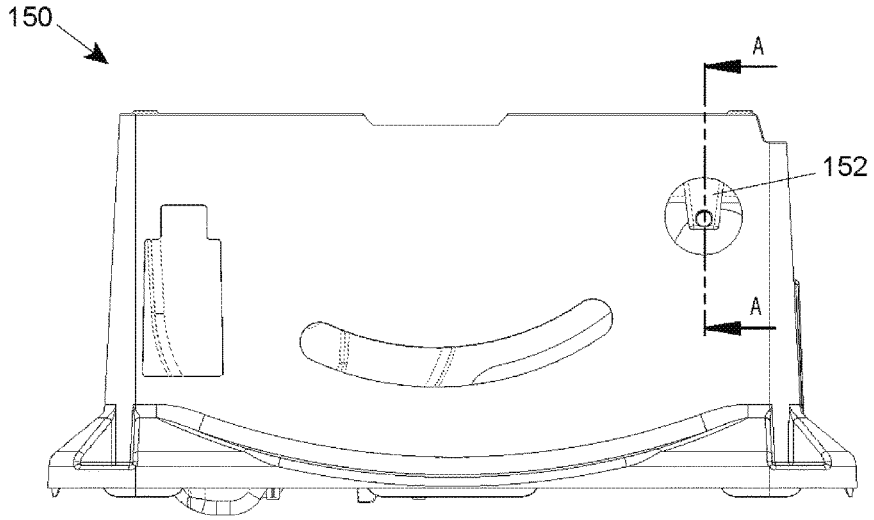
FIG. 25 shows a saw housing with an arm to support a dial used in a tilt adjustment mechanism.
Figure 26:
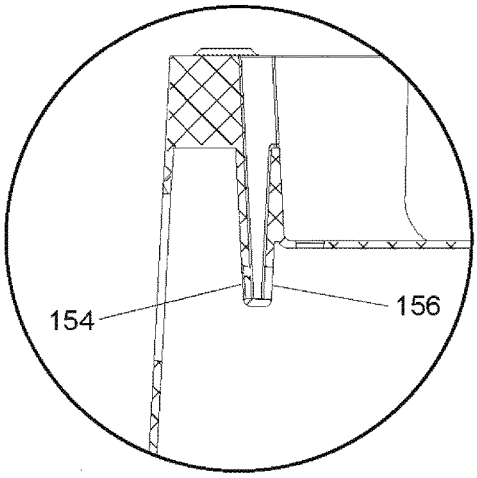
FIG. 26 shows a cross-section of the arm shown in FIG. 25.
Figure 27:
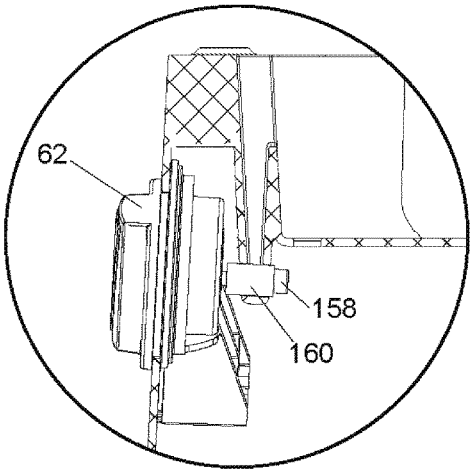
FIG. 27 shows a dial supported by the arm shown in FIG. 25.

Dial 62 may be supported in the saw by "sandwiching" the housing, as mentioned above. Dial 62 may also be supported by an arm formed as part of the housing, as shown in FIGS. 25 through 27. FIG. 25 shows a housing 150 made as a molded, plastic part, and an arm 152 extends down to provide a support for dial 62. Supporting the dial with an arm helps maintain the position of the dial if the outer wall of the housing flexes. FIG. 26 is a cross-sectional view taken along the line A-A in FIG. 25, showing arm 152 with holes 154 and 156. As shown in FIG. 27, a bolt 158 and a spacer 160 may extend through holes 154 and 156 to support dial 62.

Figure 12:
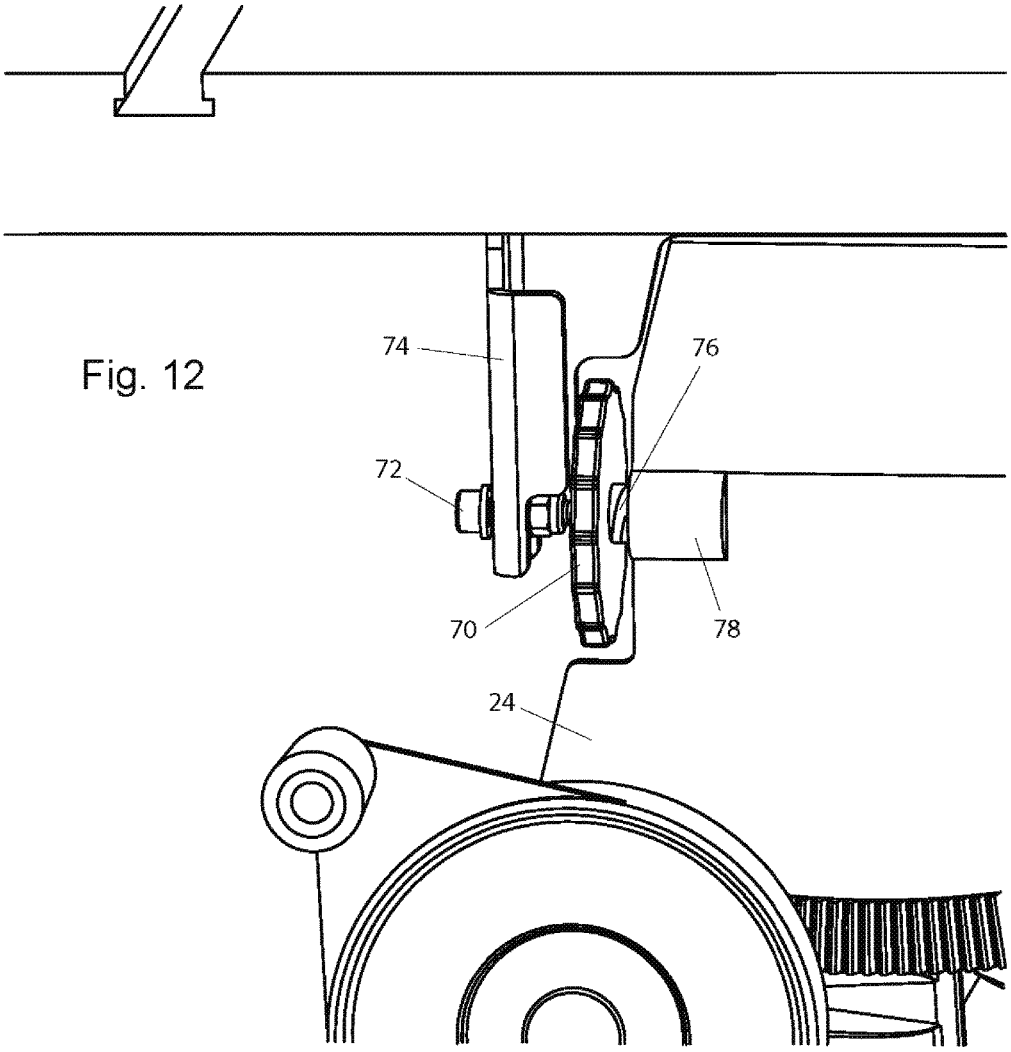
FIG. 12 shows a dial used in the adjustment mechanism shown in FIG. 11.

FIGS. 11-13 show another embodiment of an adjustment mechanism. In this embodiment, a dial 70 is threaded on a bolt 72 held by a bracket 74 mounted to table 12. Dial 70 extends through an opening in the front of the housing so a user can turn the dial to adjust the tilt. Dial 70 includes a threaded projection 76 that threads into a socket 78 in rack 24. Turning dial 70 turns threads 76, which in turn move rack 24. Threads 76 are configured to provide sufficient motion of rack 24 when dial 70 is turned a desired amount.

Figure 14:
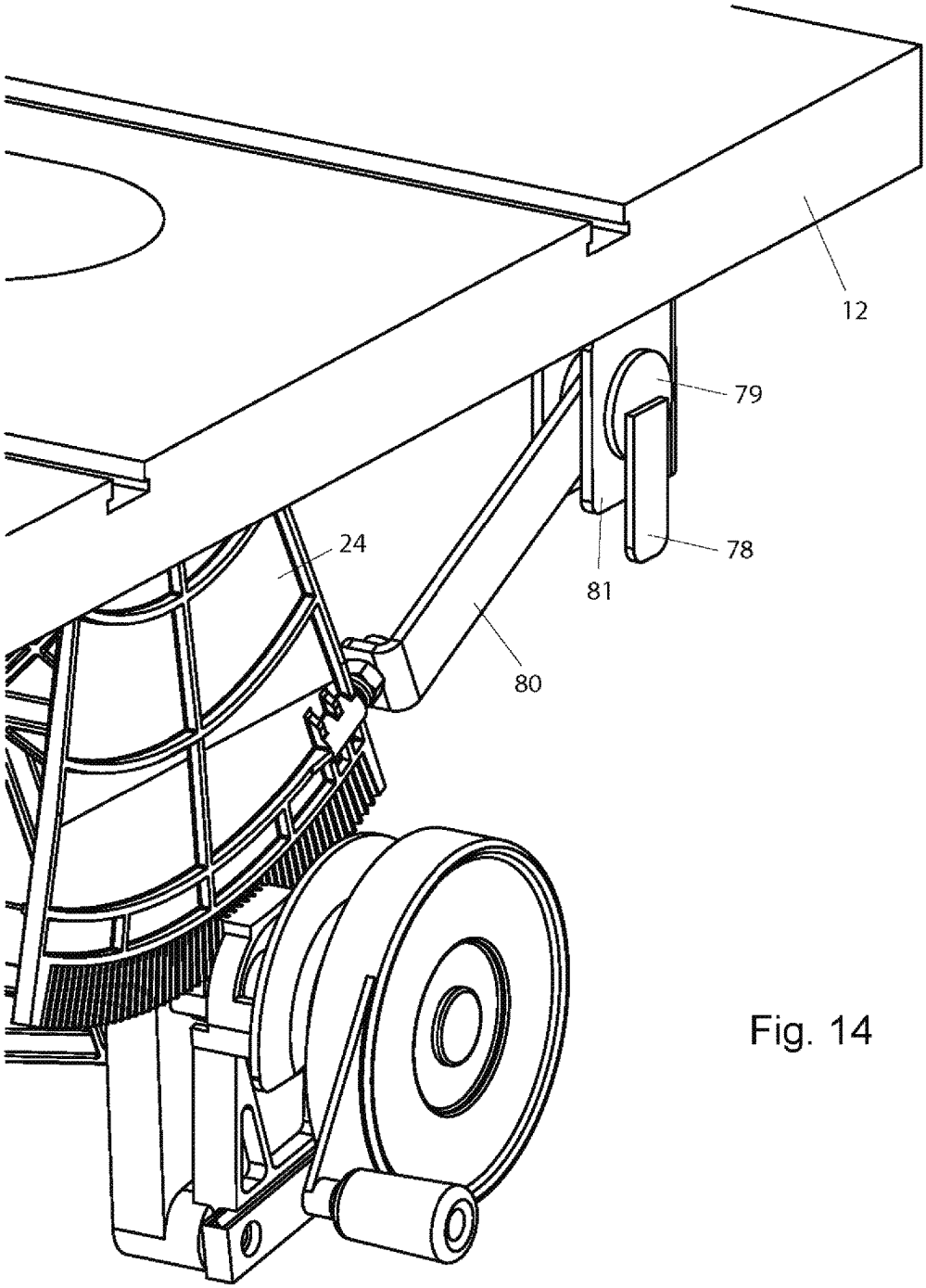
FIG. 14 shows another embodiment of an adjustment mechanism.

FIG. 14 shows another embodiment of an adjustment mechanism. This embodiment includes a handle 78 on an eccentric 79. The eccentric is linked to an arm 80 connected to rack 24. The eccentric is supported by a bracket 81 mounted to table 12. A user turns the handle to turn the eccentric, and the eccentric then moves arm 80 and rack 24 back and forth.

Figure 15:
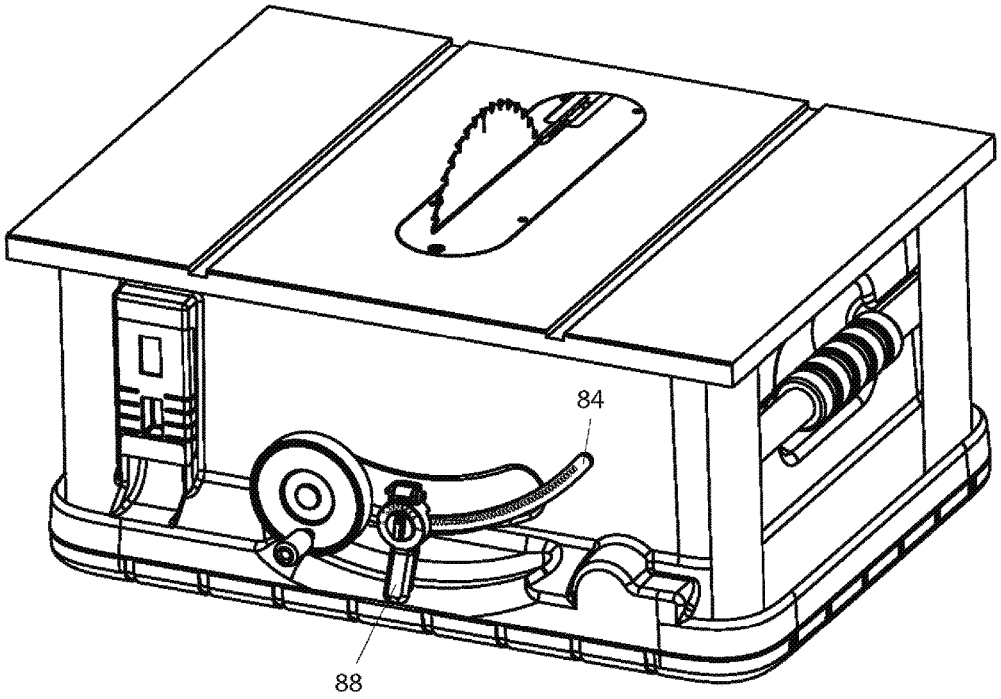
FIG. 15 shows another embodiment of a tilt mechanism.
Figure 16:
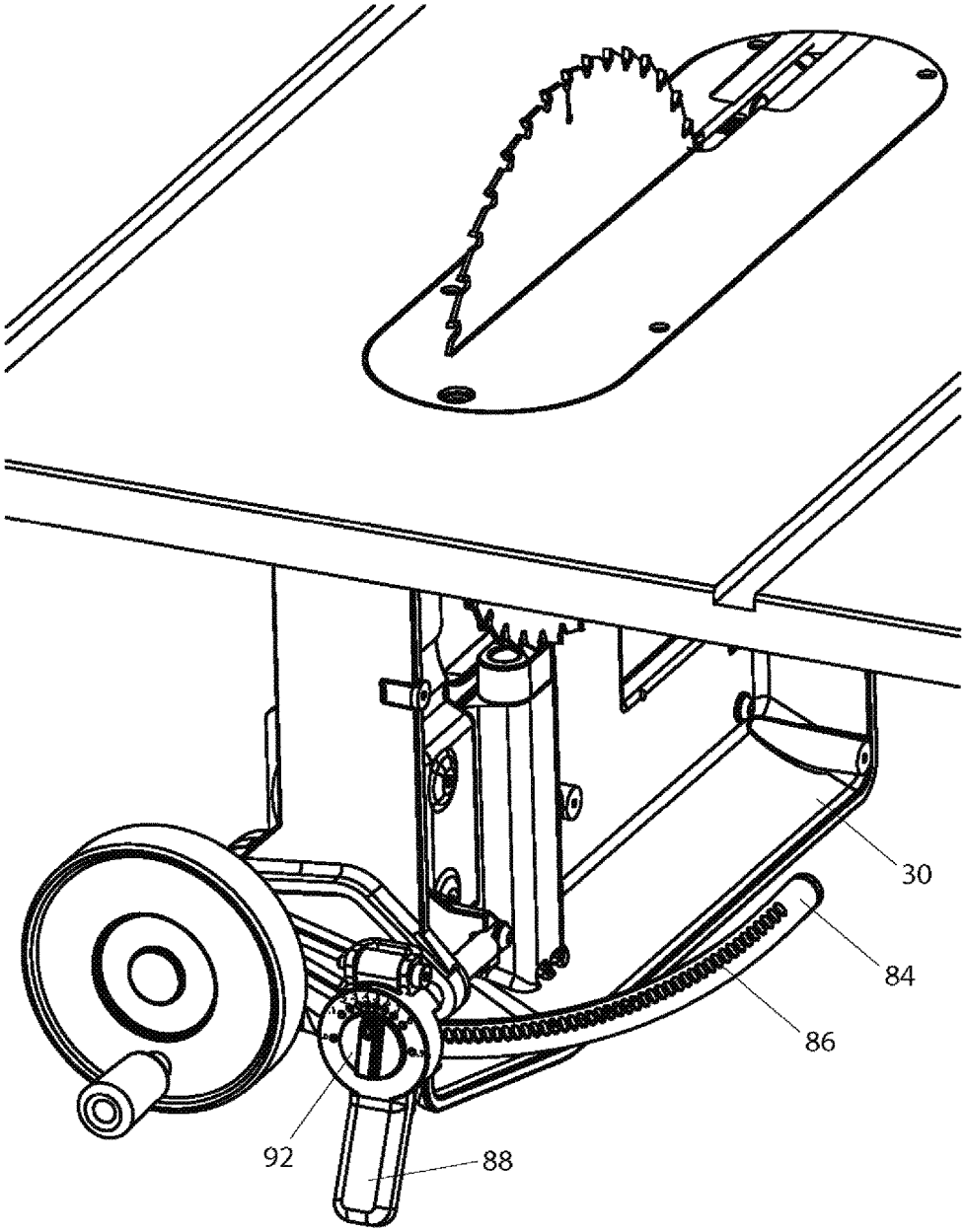
FIG. 16 shows the tilt mechanism of FIG. 15 with the housing removed for clarity.
Figure 17:
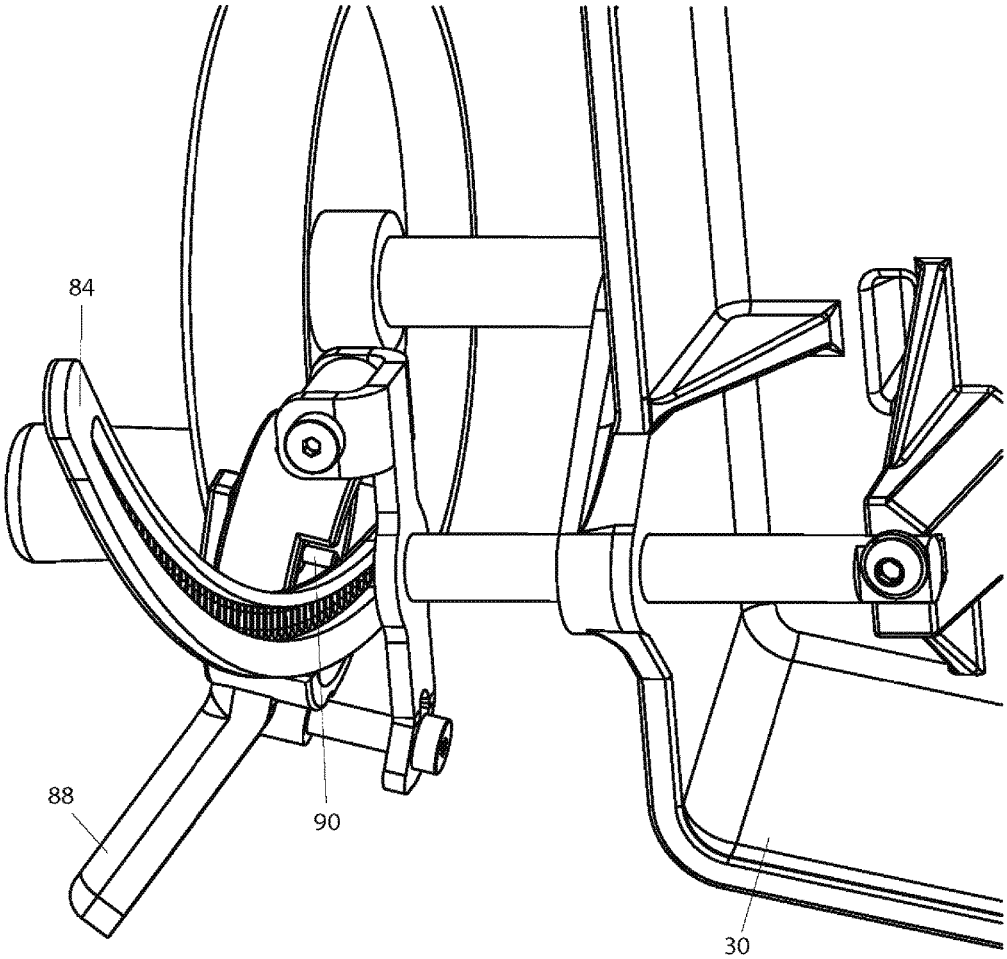
FIG. 17 shows a pin used in the tilt mechanism of FIG. 15.

FIGS. 15-17 show another embodiment of a tilt mechanism that provides and index or indices allowing a user to tilt the blade to defined positions. The mechanism includes an arcuate bracket or index 84 having apertures or holes, such as hole 86 in FIG. 16, spaced at defined intervals, such as every 1-degree. A handle 88 is mounted in the saw adjacent index 84. The back side of the handle includes a pin 90 configured to fit into the holes in index 84. The handle is adapted to pivot so that a user can move pin 90 into and out of the holes in index 84. Other structure in the saw provides support for handle 88 and holds handle 88 in position so that pin 90 aligns with the holes in index 84. Index 84 can be mounted on the outside of the saw's housing, as shown in FIG. 15, or it can be mounted to the inside of the saw provided there is an opening in the housing to allow pin 90 to engage the index. A user operates this tilt mechanism by pulling the handle out, tilting the blade to a desired position, and releasing the handle so that pin 90 moves into one of the holes in the index. The handle can be spring-biased so that pin 90 moves toward index 84 and through a hole when the handle is released.

A different embodiment of an alternative adjustment mechanism can be used with the tilt mechanism shown in FIGS. 15-17. A dial 92 can be positioned in handle 88, as shown in FIG. 16. Pin 90 is mounted to the back of the dial and handle 88 is attached to trunnion 30 so that the trunnion and blade move with the handle. In use, turning the dial moves both the handle and trunnion because pin 90 engages index 84 which is fixed to the saw's housing.

Variations of the above-described embodiments are possible within the scope of this disclosure.

INDUSTRIAL APPLICABILITY

The blade tilt mechanisms disclosed herein are applicable to woodworking power tool equipment, and particularly to table saws. The tilt mechanisms discussed above may be referred to as tilt means for positioning the blade at desired angles, tilt means for changing the angle of the blade relative to a work surface, means for tilting, or some other similar appellation.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and sub-combinations of the various elements, features, functions and/or properties disclosed herein. No single feature, function, element or property of the disclosed embodiments is essential to all of the disclosed inventions. Similarly, the recitation of "a" or "a first" element, or the equivalent thereof, should be understood to include incorporation of one or more such elements, neither requiring nor excluding two or more such elements.

It is believed that the following claims particularly point out certain combinations and sub-combinations that are directed to disclosed inventions. Inventions embodied in other combinations and sub-combinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

The invention claimed is:

1. A table saw comprising:

a table defining a work surface;

a substantially planar, circular blade configured to extend at least partially above the work surface;

a motor to spin the blade; and a tilt mechanism configured to set the angle of the plane of the blade relative to the work surface, where the tilt mechanism includes a rack with teeth and an engagement member having at least one tooth configured to engage the rack by fitting between teeth on the rack, where the angle of the plane of the blade is set by the position along the rack where the tooth fits between teeth on the rack, where at least a portion of the engagement member is movable by a user to disengage the tooth from the rack, where the engagement member is configured so that when the tooth on the engagement member is disengaged from the rack a user can move the engagement member to change the angle of the plane of the blade, where the teeth on the rack comprise indices spaced at defined intervals, where the angle of the plane of the blade relative to the work surface is set by the defined intervals.

2. The table saw of claim 1 where the defined intervals are spaced 1-degree apart.

3. The table saw of claim 1 where the defined intervals are spaced less than 1-degree apart.

4. The table saw of claim 1 where the defined intervals are spaced more than 1-degree apart.

5. The table saw of claim 1 further comprising an adjustment mechanism to adjust the angle of the plane of the blade between the defined intervals.

* * * * *